US006401836B1

(12) United States Patent
Heinrichs et al.

(10) Patent No.: US 6,401,836 B1
(45) Date of Patent: Jun. 11, 2002

(54) SPEED REGULATING APPARATUS FOR A PNEUMATIC TOOL

(75) Inventors: Kevin Heinrichs, Lopatcong, NJ (US); John A. McCallops, Easton, PA (US); Mark J. Hamlin, Boonton, NJ (US); Mario Craciun, Bethlehem, PA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/515,471

(22) Filed: Feb. 29, 2000

(51) Int. Cl.[7] ..... B25D 11/04
(52) U.S. Cl. ..... 173/93; 173/168; 173/169
(58) Field of Search ..... 173/93, 93.5, 93.6, 173/168, 169

(56) References Cited

U.S. PATENT DOCUMENTS 3,373,824 A * 3/1968 Whitehouse ..... 173/12
3,752,241 A * 8/1973 Bent ..... 173/163
3,802,538 A * 4/1974 Brown ..... 181/36
4,082,475 A * 4/1978 Kuder ..... 408/125
4,416,338 A * 11/1983 Nelson et al. ..... 173/134
4,773,487 A * 9/1988 Ringer ..... 173/18
4,962,787 A 10/1990 Mayhew ..... 137/556.3
5,205,540 A 4/1993 Clapp ..... 251/339
5,992,539 A * 11/1999 Lin ..... 173/93

* cited by examiner

*Primary Examiner*—Scott A. Smith
*Assistant Examiner*—Chukwurah Nathaniel
(74) *Attorney, Agent, or Firm*—Leon Nigohosian, Jr.

(57) ABSTRACT

A pneumatic tool having a housing with at least one exhaust opening and a speed regulating apparatus. The speed regulating apparatus has a cap that is removably mounted on the housing and has at least one exhaust port in fluid communication with the at least one exhaust opening. A control ring is provided having at least one aperture in fluid communication with and rotatably mounted over the at least one exhaust port, with the control ring being movable to variably open and close the at least one exhaust port.

4 Claims, 3 Drawing Sheets

SPEED REGULATING APPARATUS FOR A PNEUMATIC TOOL

BACKGROUND OF THE INVENTION

The present invention relates to a fluid flow regulating apparatus for a fluid mechanism and in particular to an exhaust flow speed regulating apparatus for a handheld pneumatic power tool.

In assembly and manufacturing processes involving power tools, speed control has become a desired feature due to the increased use of composite and laminate materials in end product designs. These materials are much more sensitive to tool speeds due to burning and chipping that can occur during machining processes. Moreover, the higher expectation of tolerance control during machining does not permit over-powering powering a power tool through such materials. These problems encountered although prevalent in generally all machining processes are particularly exacerbated during high-speed operations such as drilling.

Thus, it is desirable to obtain different motor speeds for a power tool using the same motor construction. Typically this can be done by sizing and shaping an orifice in the fluid flow path to restrict fluid flow to a predetermined mass rate of flow, thus limiting motor speed. Such speed regulation is typically accomplished by regulating air on the inlet side of the motor using a variable regulating valve or, alternatively, with many single use permanent parts. However, the disadvantages of the known speed regulating devices are that regulating valves are complex and subject to wear and partial operation. Permanent parts reduce the flexibility of converting the tool and create logistical problems in manufacturing the various parts. Both alternatives are costly to construct. Moreover, when reducing the speed of a tool by regulating the inlet air to the tool, the stall torque and horsepower of the motor are significantly lowered.

The foregoing illustrates limitations known to exist in present pneumatic operated power tools. Thus it is apparent that it would be advantageous to provide an alternative directed to overcoming one or more of the limitations set forth above. Accordingly a suitable alternative is provided including the features more fully disclosed hereinafter.

SUMMARY OF THE INVENTION

According to the present invention, a speed regulating apparatus for a pneumatic tool is provided having a housing with at least one exhaust opening and a speed regulating apparatus. The speed regulating apparatus has a cap that is removably mounted on the housing and has at least one exhaust port in fluid communication with the at least one exhaust opening. A control ring is provided having at least one aperture in fluid communication with and rotatably mounted over the at least one exhaust port, with the control ring being movable to variably open and close the at least one exhaust port.

The foregoing and other aspects of the present invention will become apparent from the following detailed description of the invention when considered in conjunction with the accompanying drawings. It must be understood, however, that the figures are not intended as definitions of the invention but are only for the purpose of illustration.

DETAILED DESCRIPTION OF THE PREFERRED EMBODIMENTS

Figure 1:
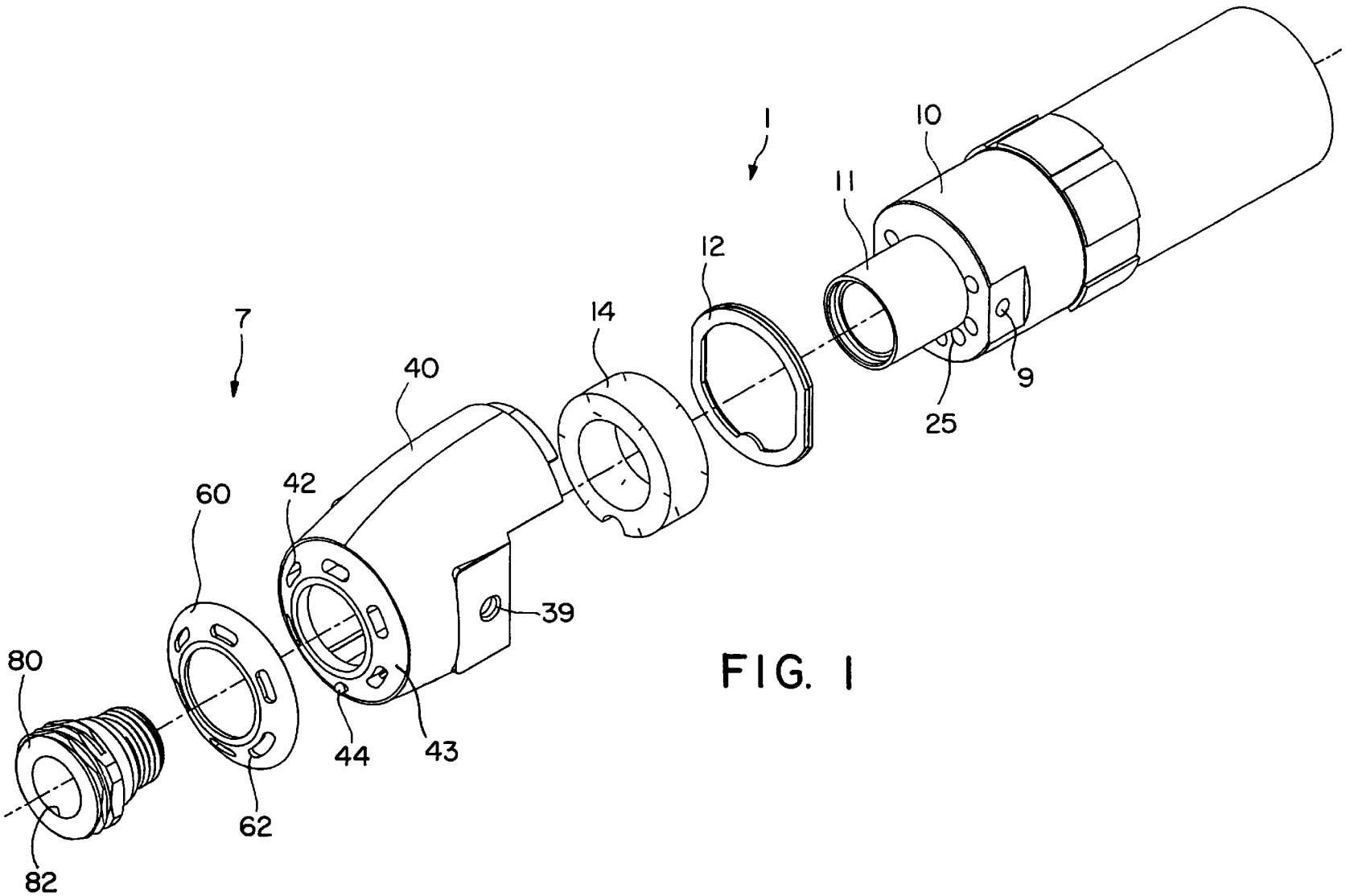
FIG. 1 is a front perspective view of a speed regulating apparatus of the present invention incorporated into a pneumatic tool.

The invention is best understood by reference to the accompanying drawings in which like reference numbers refer to like parts. It is emphasized that, according to common practice, the various dimensions of the pneumatic tool and the associated component parts as shown in the drawings are not to scale and have been enlarged for clarity.

Referring now to FIGS. 1–4, a handheld pneumatic power tool 1 is disclosed having a housing 10 with at least one exhaust opening 25 and a speed regulating apparatus 7. The speed regulating apparatus 7 has a cap 40 that is removably mounted on the housing 10 and has at least one exhaust port 42 in fluid communication with the at least one exhaust opening 25. A control ring 60 is provided having at least one aperture 62 in fluid communication with and rotatably mounted over the at least one exhaust port 42, with the control ring 60 being movable to variably open and close the at least one exhaust port 42. The tool includes a bushing 80 having an axial fluid inlet 82 and a housing 10 having a tubular portion 11 which is connected to or integrally provided on housing 10. Fluid inlet 82 provides motive fluid to housing 10. Tubular portion 11 and bushing 80 are threadingly engageable to clamp control ring 60 to cap 40 upon tightening and to permit relative rotation between control ring 60 and cap 40 upon loosening. Preferably, tubular portion 11 is internally threaded to receive a threaded portion provided externally on bushing 80. As described further in detail below, tubular portion 11 is journalled through axial holes located in cap 40 and control ring 60 and axially engageable with bushing 80.

Figure 4:
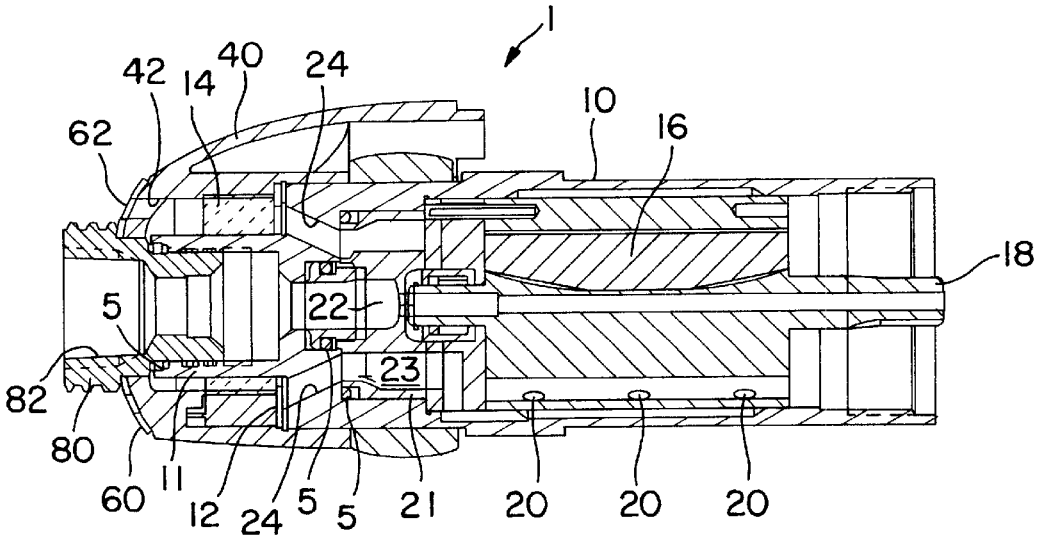
FIG. 4 is a cross-sectional side view of the speed regulating apparatus of the present invention incorporated into the assembled pneumatic tool shown in FIG. 3 taken along the sectional line designated "4—4"

A fluid motor 16 is provided within housing 10 which produces rotary output for an output spindle 18 as shown in FIG. 4. Housing 10 is configured to receive a driving section (not shown) that is driven by fluid motor 16 via output spindle 18. Although fluid motor 16 is shown illustrated as a pneumatic vane motor, the present invention can be adapted for any fluid-powered motor. Fluid motor 16 is driven by a motive fluid provided from inlet 82 via an inner passage 22 of a reverse valve 21. As shown in FIG. 4 the exhaust fluid from the vane motor exits the motor chamber by exhaust ports 20. From exhaust ports 20 the exhaust fluid is directed through an outer passage 23 of reverse valve 21 into an exhaust passageway 24 and out of housing 10 via exhaust openings 25.

According to the present invention, located between inlet 82 and exhaust openings 25 is a speed regulating apparatus 7 that controls the speed of pneumatic tool 1 by varying the flow rate of air exiting the tool. Speed regulating apparatus 7 includes a cap 40 and an exhaust control ring 60 that is rotatably mounted thereon that controls and diffuses fluid flow through cap 40. Cap 40 has a shoulder 43 with exhaust ports 42 that are in fluid communication with exhaust openings 25 of housing 10 as shown in FIG. 4. Preferably an exhaust element 14 is provided which is made of a porous material that diffuses/slows fluid flow for acoustical muffling purposes as the motive fluid passes from exhaust passageway 24 to exhaust ports 42.

Figure 2:
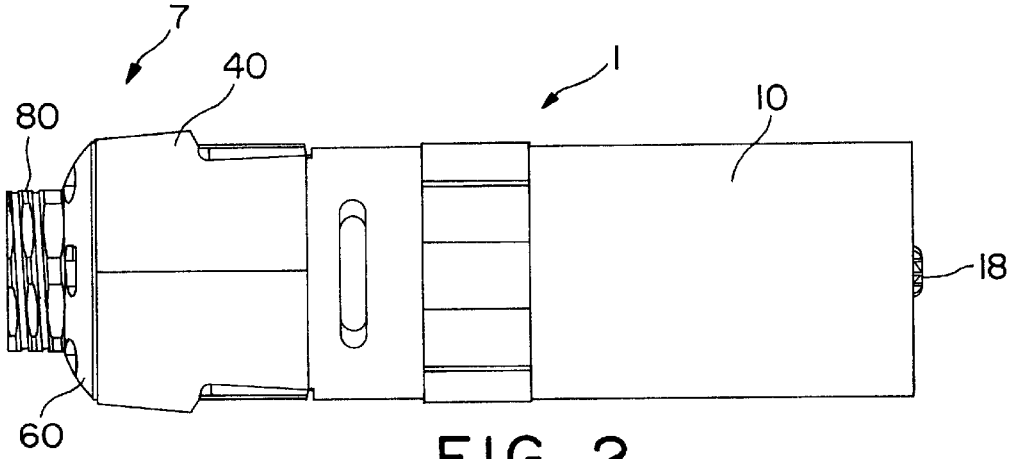
FIG. 2 is a bottom view of the assembled components of the pneumatic tool shown in FIG. 1.
Figure 3:
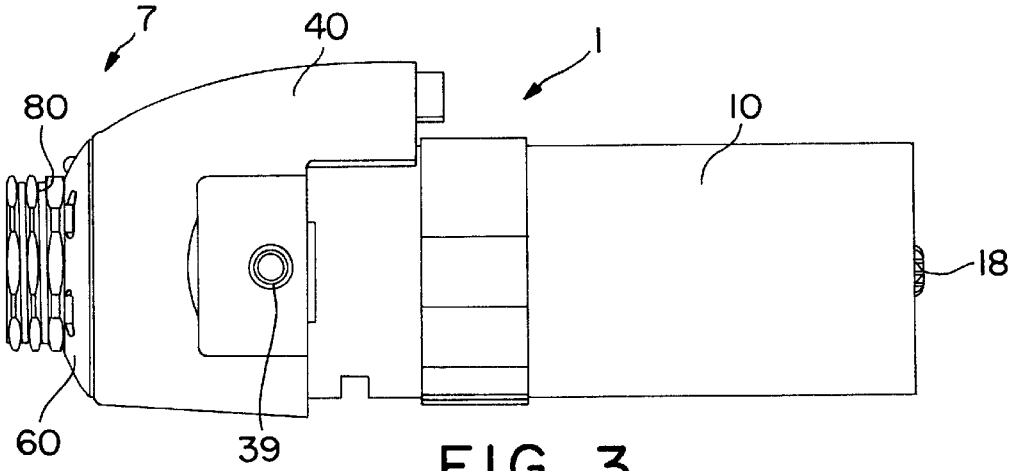
FIG. 3 is a side view of the assembled components of the pneumatic tool shown in FIG. 1.

Control ring 60, cap 40, and exhaust element 14 are coaxially mounted on tubular portion 11 between bushing 80 and the exhaust openings 25 of housing 10 in order as shown in FIGS. 1 and 4. O-rings 5 and a gasket 12 are provided at the joints between the component parts as shown in FIG. 4 to seal their mating surfaces against fluid losses. Preferably, screw holes 9 and 39 are provided in housing 10 and cap 40, respectively, for receiving a mounting screw (not shown) which fastens the cap and housing together when assembled as shown in FIGS. 2 and 3.

Figure 5:
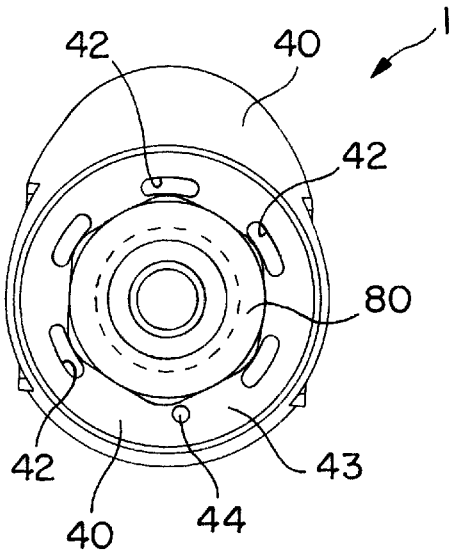
FIG. 5 is a front view of the assembled components of the pneumatic tool shown in FIG. 1 with the control ring removed.
Figure 6:
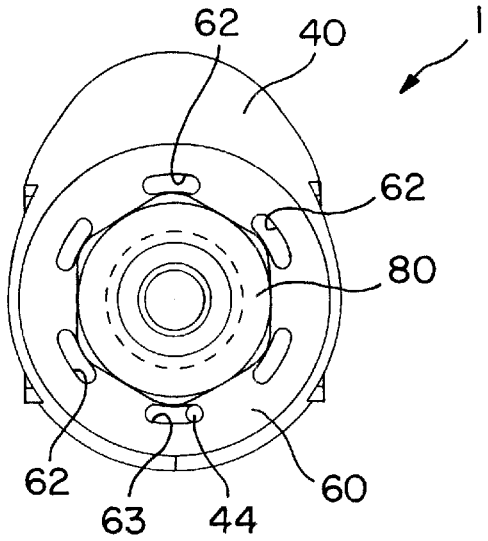
FIG. 6 is a front view of the assembled components of the pneumatic tool shown in FIG. 1.

As shown in FIG. 6, apertures 62 are provided in number and spacing to correspond with exhaust ports 42 in shoulder 43 shown in FIG. 5. To adjust the speed while running pneumatic tool, a tool operator simply loosens bushing 80 to permit control ring 60 to rotate freely. After turning control ring 60 to vary the opening size of exhaust ports 42 until the desired speed output is obtained, the tool operator then re-tightens bushing 80 to maintain the control ring 60 in the desired position. By this configuration, the position of control ring 60 is maintained over time to ensure that the size of exhaust ports 42 does not vary after it is adjusted.

As can be seen in FIG. 6, apertures 62 of control ring 60 and exhaust ports 42 in shoulder 43 are shown in the fully open position and, preferably, are openings having rounded ends to facilitate fine-tuning the opening size of exhaust ports 42. Preferably a detent 44 is provided on shoulder 43 which fits into an aperture 63 located in control ring 60.

The detent 44 is configured to engage aperture 63 to signal a user when control ring 60 is rotated to a predetermined position which, as shown in FIG. 6, can be in the fully open position. In order to prevent stalling of tool 1, detent 44 prevents exhaust ports 42 from being completely closed by control ring 60 to permit some leakage of air from inlet 80 out of apertures 62. Preferably, the amount of air leakage is designed to permit speed control down to 50% of the original tool free speed when control ring 60 is rotated to close down exhaust ports 42. By controlling the tool speed by regulating exhaust air rather than inlet air, the speed regulating apparatus of the present invention provides an added benefit that upon reducing the tool speed, the stall torque and horsepower are significantly higher than if the air was regulated on the inlet side of the tool as is done with common speed regulation valves.

Figure 7:
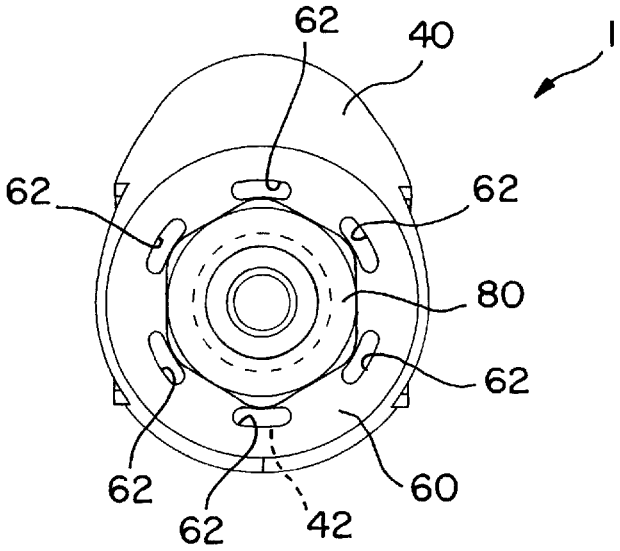
FIG. 7 is a front view of an alternative embodiment of the assembled pneumatic tool shown in FIGS. 1–6 having an alternate housing design without a detent.

Shown in FIG. 7 is an alternate embodiment which is the same as that shown in FIGS. 1–6 except that detent 44 is replaced by an additional exhaust port 42 located in shoulder 43. By this construction, control ring 60 may be mounted so that it is fully rotatable on shoulder 43 to prevent over-tightening or loosening by an operator which would otherwise render the speed regulating apparatus 7 inoperable. By this design, if an operator during adjustment of the speed regulating apparatus rotates the control ring 60 too far, the tool simply returns to the speed the operator started at without any component failures. In order to prevent stalling of tool 1 when exhaust ports 42 are closed by control ring 60, the O-ring seals 5 between the component parts are designed to permit some leakage of air from inlet 82 across the joints between the component parts. Preferably, the amount of air leakage is designed to permit speed control down to 50% of the original tool free speed when exhaust ports 42 are closed by control ring 60.

While this invention has been illustrated and described in accordance with a preferred embodiment related to a hand-held pneumatic power tool, it is contemplated that the speed regulating apparatus according to the present invention may be incorporated into other pneumatic devices in which exhaust speed control is desired.

Moreover, while embodiments and applications of this invention have been shown and described, it will be apparent to those skilled in the art that many more modifications are possible without departing from the inventive concepts herein described. For example, although exhaust ports 42 of cap 40 and apertures 62 of exhaust control ring 60 are shown and described having particular configurations it is envisioned that the shapes and sizes of these components may be varied to optimize the speed control capability of the speed regulating apparatus. It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A pneumatic tool comprising:

a housing having a tubular portion and at least one exhaust opening;

a speed regulating apparatus having a cap removably mounted on said housing and having at least one exhaust port in fluid communication with said at least one exhaust opening;

a control ring having at least one aperture in fluid communication with and rotatably mounted over said at least one exhaust port, said control ring being movable to variably open and close said at least one exhaust port; and a bushing, said tubular portion being journalled through axial holes located in said cap and said control ring and axially engageable with said bushing.

2. The pneumatic tool according to claim 1 wherein said tubular portion and said bushing are threadingly engageable to clamp said control ring to said cap upon tightening and to permit relative rotation between said control ring and said cap upon loosening.

3. The pneumatic tool according to claim 2 wherein said cap comprises a detent, said detent being configured to engage one of said at least one apertures upon rotating said control ring to a predetermined position.

4. The pneumatic tool according to claim 2 wherein said bushing comprises an axial fluid inlet for providing motive fluid to said housing.

* * * * *